US008510894B2

(12) United States Patent
Mrouse

(10) Patent No.: US 8,510,894 B2
(45) Date of Patent: Aug. 20, 2013

(54) SURFACE CLEANING SYSTEM

(76) Inventor: Elizabeth B. Mrouse, Gales Ferry, CT (US)

( * ) Notice: Subject to any disclaimer, the term of this patent is extended or adjusted under 35 U.S.C. 154(b) by 748 days.

(21) Appl. No.: 12/629,932

(22) Filed: Dec. 3, 2009

(65) Prior Publication Data

US 2011/0131744 A1 Jun. 9, 2011

(51) Int. Cl.
*B05C 1/00* (2006.01)

(52) U.S. Cl.
USPC ..... 15/230.11

(58) Field of Classification Search
USPC ..... 15/210.1, 230.11, 230.12, 244.1, 15/244.3; 118/264, 14, 15; 492/13, 16–17, 492/19, 28–31, 38, 48, 53, 56, 59; 401/197
See application file for complete search history.

(56) References Cited

U.S. PATENT DOCUMENTS 2,799,886 A * 7/1957 Brunelli et al. ..... 15/248.2
3,425,086 A * 2/1969 Ball ..... 15/230.11
3,986,226 A * 10/1976 Roe et al. ..... 15/230.11
4,466,151 A * 8/1984 Barch et al. ..... 15/229.13
5,146,646 A * 9/1992 Langford et al. ..... 15/210.1
5,461,749 A 10/1995 Ahlberg et al.
5,996,166 A * 12/1999 Shehow ..... 15/230.11
6,928,688 B2 8/2005 Nam
6,976,284 B1 * 12/2005 Manfredi et al. ..... 15/230.11
7,240,391 B1 7/2007 Boze et al.
7,356,869 B2 4/2008 Knopow et al.
7,470,652 B2 12/2008 Kilkenny et al.
7,487,567 B2 2/2009 Kresse et al.
7,566,671 B2 7/2009 Hoadley et al.
7,600,286 B2 10/2009 Schmidt
2003/0217427 A1 * 11/2003 Martin ..... 15/230.11
2006/0179596 A1 * 8/2006 Sharratt ..... 15/230.11
2008/0244854 A1 * 10/2008 Mignano ..... 15/230.11

* cited by examiner

*Primary Examiner* — Todd Manahan
*Assistant Examiner* — Brianne Kalach
(74) *Attorney, Agent, or Firm* — Anthony D. Pellegrini

(57) ABSTRACT

An improved surface cleaning system comprising a cleaning surface comprised of microfiber material suitable to be used with a roller rotatably attached to a handle.

16 Claims, 12 Drawing Sheets

SURFACE CLEANING SYSTEM

BACKGROUND OF THE INVENTION

1. Technical Field

The invention relates generally to the field of household cleaning devices, and in particular to a device for cleaning surfaces, such as ceilings and walls.

2. Description of Prior Art

Walls and ceilings as well as floors become dusty and dirty. Walls and ceilings are harder to clean than floors because there are few options. Cleaning systems for such surfaces are well known. These include the most simple of devices, such as a cloth, rag, or a sponge, to more complicated devices, such as a mop or a brush, to be used either dry or in conjunction with a cleaning fluid, to devices using adhesives, such as lint rollers. Advanced materials may be used, such as a microfiber cleaning cloth. For all known cleaning devices, the cleaning device is rubbed over the surface, relying on friction to dislodge the dirt. In some cases the cleaning device fails to capture the dislodged dirt, however, and merely moves the dirt into the surrounding air.

Using friction to dislodge dirt particles can potentially damage the surface to be cleaned, as well as increasing the effort required of the user. This is especially true where the surface to be cleaned is not perfectly smooth, such as a textured ceiling. In such cases the texture of the surface will impede the movement of the cleaning device, perhaps even scraping dirt off the cleaning device and returning it to the surface. Where adhesives are used, an unwanted residue may be left behind.

A solution to the problem of cleaning large surfaces with different textures involves finding an easier way to move the cleaning material over the large surface without losing its effectiveness for cleaning. Replacing the frictional operational mechanism of existing cleaning devices with a roller partially achieves this solution, by reducing the effort needed to move the cleaning device over the surface to be cleaned. However, merely rolling a device over a surface will not lead to the cleaning of the surface unless there is also a mechanism for dislodging and capturing the dirt. This is accomplished by the use of a microfiber fabric surface on the roller.

Microfiber refers to synthetic fibers that measure less than one denier (a denier is a unit of measurement of linear mass-density and is often used to describe of the size of a fiber or filament; it is calculated as one gram per 9000 meters). The most common types of microfibers are made from polyesters, polyamides (nylon), and or a conjugation of polyester and polyamide. Microfiber is used to make non-woven, woven and knitted textiles. The shape, size and combinations of synthetic fibers are selected for specific characteristics, including softness, durability, absorption, wicking abilities, water repellency, electrodynamics, and filtering capabilities. Microfiber is commonly used for apparel, upholstery, industrial filters and cleaning products. Fabrics made with microfibers are exceptionally soft and hold their shape well. When high-quality microfiber is combined with the right knitting process it creates an extremely effective cleaning material. This material can hold up to seven times its weight in water. Microfiber products also have exceptional ability to absorb oils, and are highly attractant to dirt and dust.

Microfiber fabrics that are designed for cleaning allow cleaning on a microscopic scale. Microfiber materials can clean surface and reduce the number of bacteria by 99% as compared to 33% bacteria elimination by conventional cleaning materials. Microfiber materials have a high dust-attracting power and they can absorb fat and grease through their electrostatic properties. Microfibers get a better grip of very tiny dirt particles because of the natural adhesive forces between the tiny fibers and the tiny particles of dirt. Very tiny specs of dirt, dust, and bacteria stick to the microfibers and stay there. Moreover, microfiber leaves no residue, contrary to cotton or other fabrics.

Combining a roller with a microfiber fabric cleaning surface solves the problem of cleaning large surfaces by hand. The roller, minimizing frictional forces, moves easily over any surface, smooth or textured, and the microfiber fabric cleaning surface dislodges and capturers the dirt as it passes over the surface to be cleaned. This is an unexpected result, as frictional forces are generally desired in cleaning devices, and the minimization of frictional forces would appear to be contrary to effective cleaning.

While microfiber is used in many cleaning devices, for example in mops and cleaning cloths, no existing device has combined a microfiber cleaning surface with a roller.

It is thus an objective of the present invention to provide an improved surface cleaning system that does not rely primarily on a frictional mechanism for dislodging dirt from a surface.

It is a further objective of the present invention to provide an improved surface cleaning system that does not require adhesives to dislodge dirt from a surface.

It is a further objective of the present invention to provide an improved surface cleaning system that utilizes a roller.

It is a further objective of the present invention to provide an improved surface cleaning system that uses a microfiber fabric to dislodge and capture dirt from a surface.

It is a further objective of the present invention to provide an improved surface cleaning system that is adapted to be used either dry or with cleaning fluids.

It is a further objective of the present invention to provide an improved surface cleaning system that is reusable.

It is a further objective of the present invention to provide an improved surface cleaning system that is disposable.

It is a further objective of the present invention to provide an improved surface cleaning system that may be used with a standard paint roller.

It is a further objective of the present invention to provide an improved surface cleaning system that is dimensioned for easy cleaning of ceilings or upper walls.

Other objectives of the present invention will be readily apparent from the description that follows.

SUMMARY OF THE INVENTION

The present invention utilizes a roller with a cleaning surface comprised of microfiber fabric to dislodge dirt from surfaces. The microfiber cleaning surface may be permanently affixed to the roller or it may be a removable sleeve that is placed over a standard roller, such as a paint roller. The present invention may be adapted for dry use or use with a cleaning fluid, or both. The present invention contemplates both reusable and disposable configurations. The roller itself is attached to a handle, rotating thereabout. The handle may comprise an extension to facilitate reaching difficult to access surfaces.

More specifically, at least three different variations of the present invention are contemplated. One variation is the roller independent of the handle. While in this variation the roller does not include the handle, the roller nevertheless is suitably adapted to be rotatably attached to the handle. The second variation includes the handle with the roller. The third embodiment is a removable cover or sleeve having an outer surface of microfiber material and which can be placed onto a standard paint roller. Yet other variations are also contemplated, as disclosed herein. The foregoing examples are offered for illustrative purposes only and are not intended to limit the scope of the claims set forth below.

Other features and advantages of the present invention are described below.

DETAILED DESCRIPTION OF THE DRAWINGS

DETAILED DESCRIPTION OF THE INVENTION

Figure 1A:
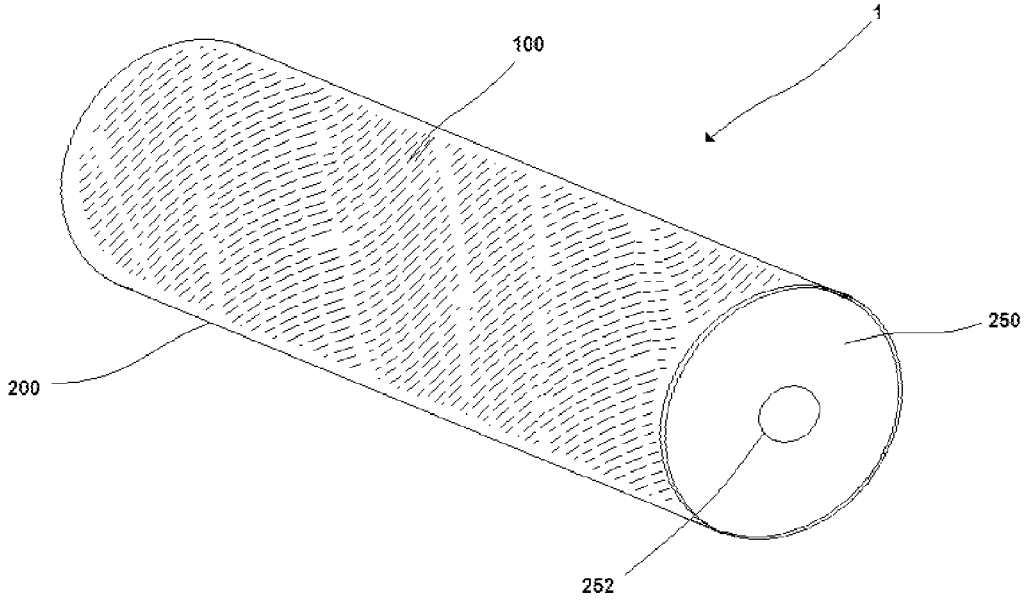
FIG. 1A depicts a perspective view of one embodiment of the present invention.
Figure 1B:
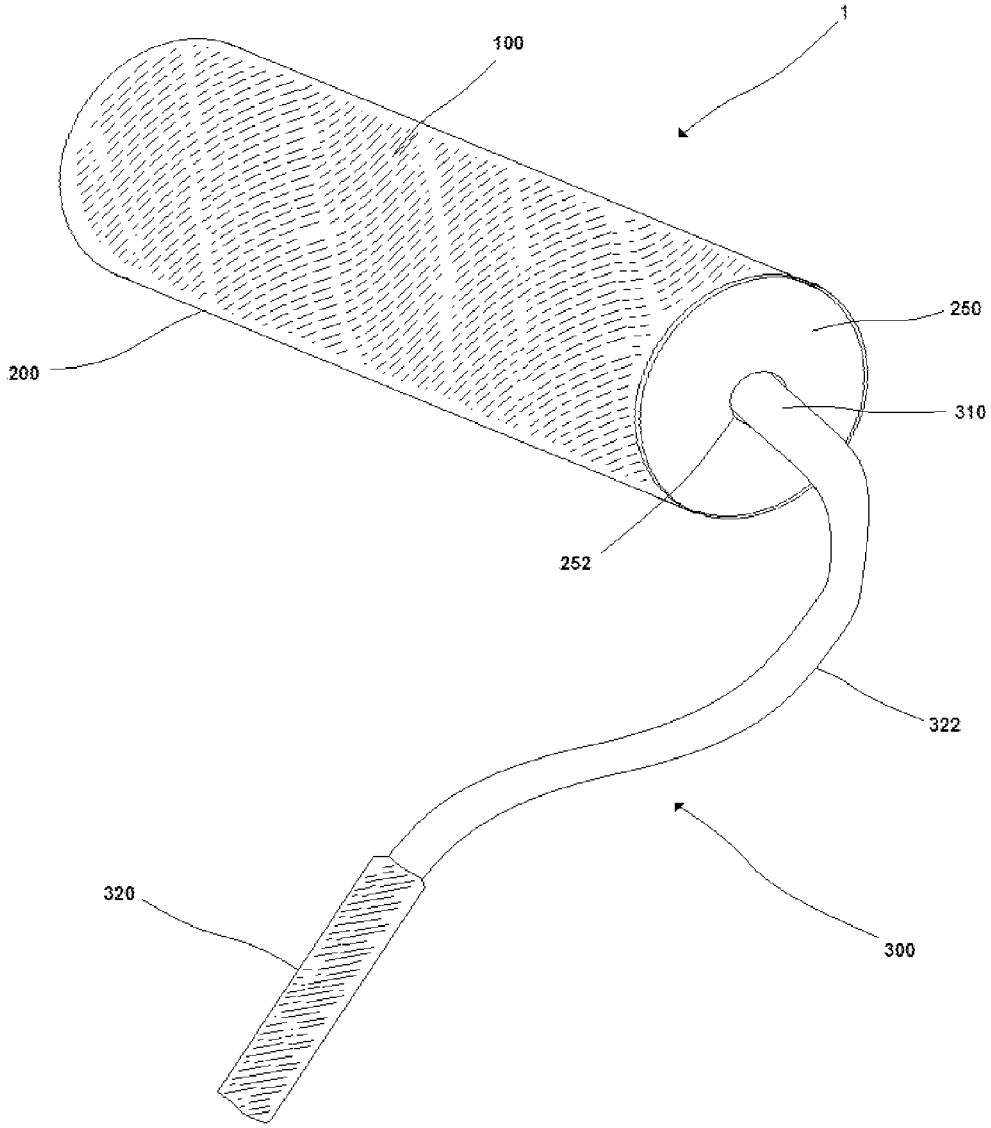
FIG. 1B depicts a perspective view of the same embodiment of the present invention as depicted in FIG. 1A, together with a handle.
Figure 7A:
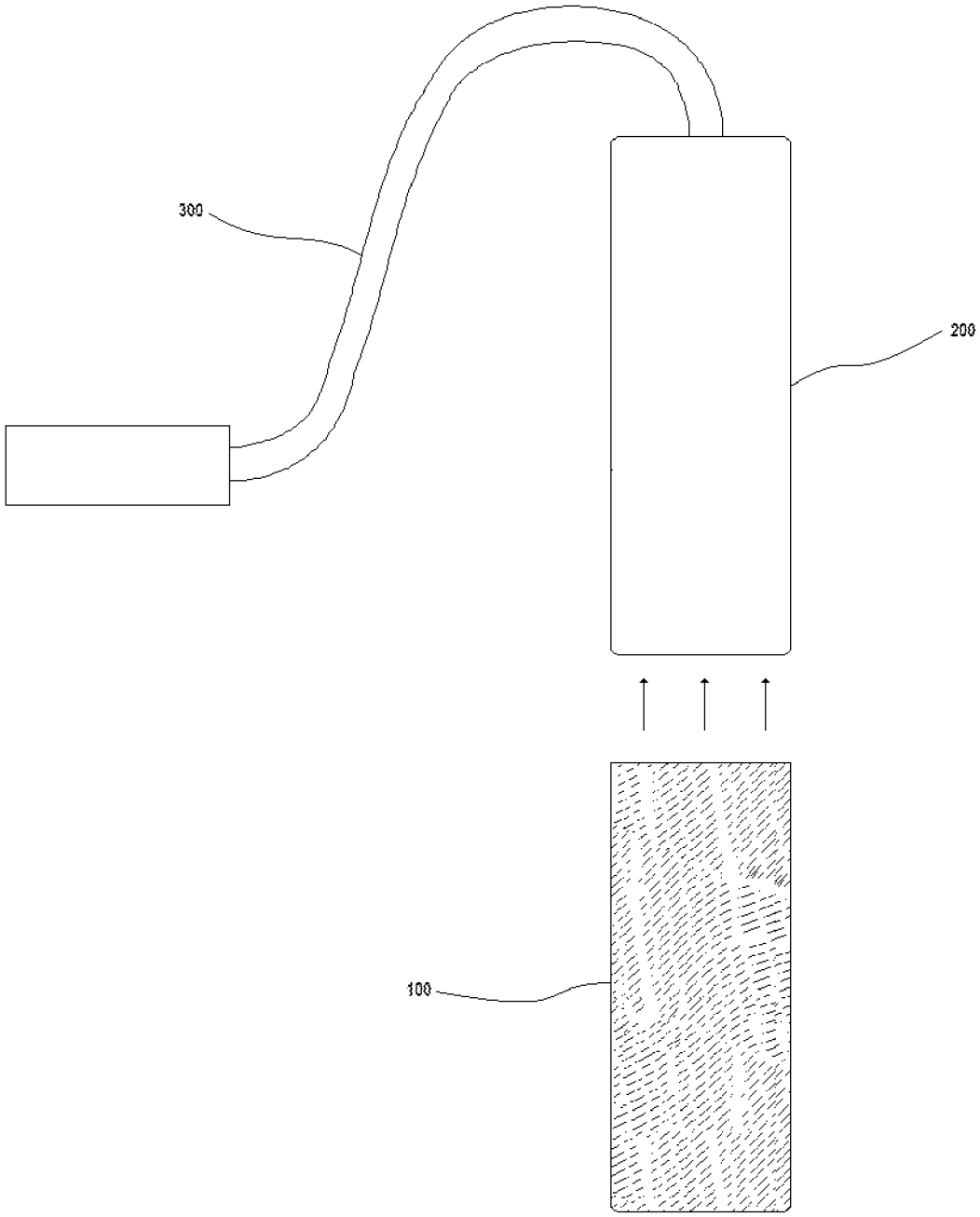
FIG. 7A depicts a view of an embodiment of the present invention wherein the cleaning surface is a removable cover.
Figure 7B:
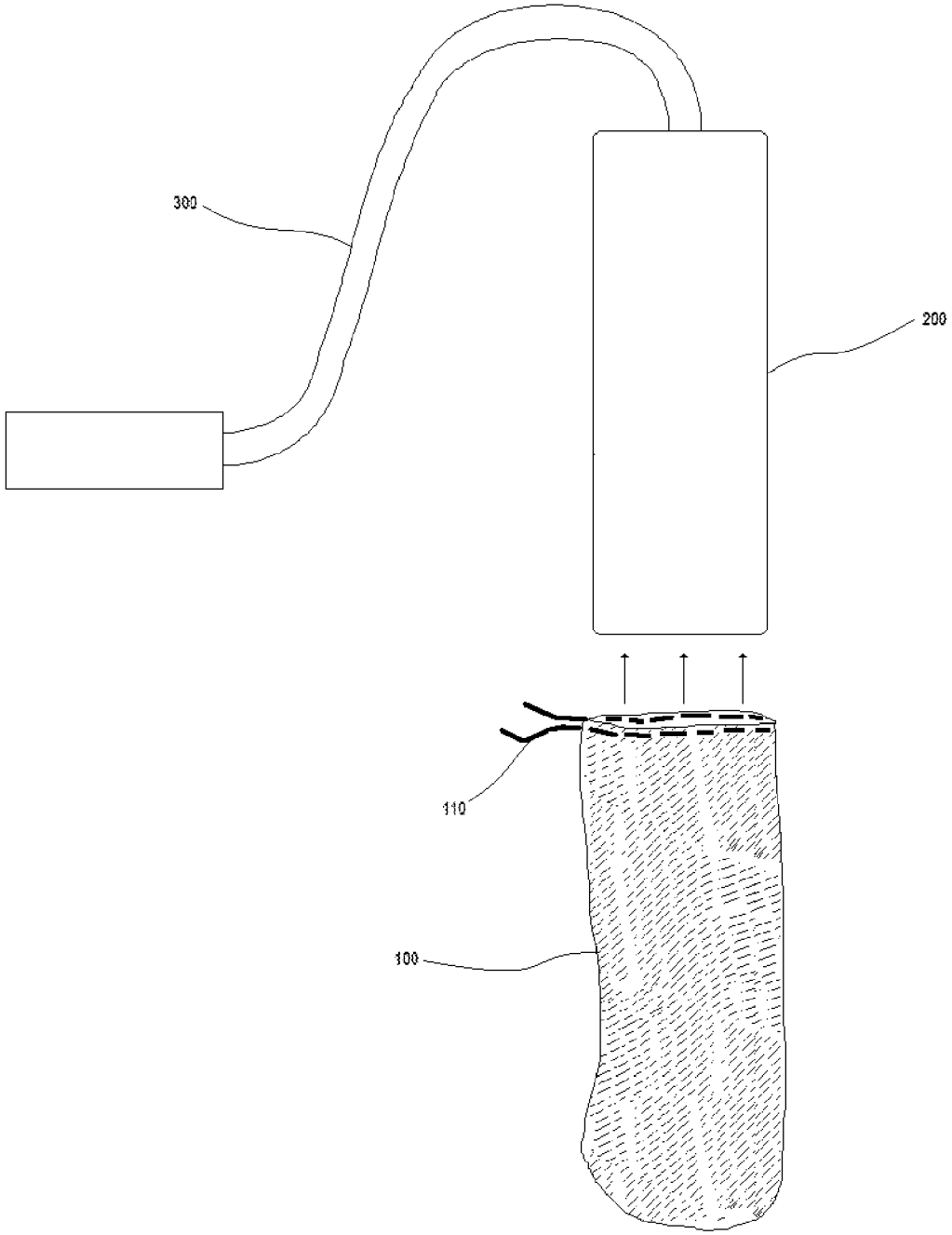
FIG. 7B depicts a view of an embodiment of the present invention wherein the cleaning surface is a removable flexible sleeve.

An aspect of the present invention discloses an improved surface cleaning system 1 comprising a roller 200 and a cleaning surface 100, with the cleaning surface 100 comprised of microfiber material. See FIG. 1A. The cleaning surface 100 is adjacent to the outer surface 210 of the roller 200, and the roller 200 is adapted to be rotatably attached to a handle 300. See FIG. 1B. So configured, a user grasping the handle 300 may place the roller 200 against a surface to be cleaned such that the cleaning surface 100 of the device contacts the surface to be cleaned, and then move the handle 300 causing the roller 200 to rotate relative to the handle 300 and along the surface to be cleaned. Another aspect of the present invention discloses an improved surface cleaning system 1 comprising a cleaning surface 100, with the cleaning surface 100 comprised of microfiber material. See FIGS. 7A and 7B. The cleaning surface 100 is adapted to be attachable to a roller 200 having a handle 300. When the cleaning surface 100 is placed onto the roller 200, a user may operate the device as described above.

In the embodiments of the present invention comprising a roller 200, the roller 200 may have any suitable shape facilitating its function. In the preferred embodiments the roller 200 is substantially cylindrical. See FIGS. 1A and 1B. In such embodiments, the roller 200 has a substantially circular cross section, its diameter is substantially constant along its length, and its length should be greater than its diameter. While any diameter and length combination that is practical may be used for cylindrical rollers 200, in the preferred embodiments the length of the roller 200 should be between four (4) and eighteen (18) inches and the diameter of the roller 200 should be between one and a half (1½) and three (3) inches.

Figure 6A:
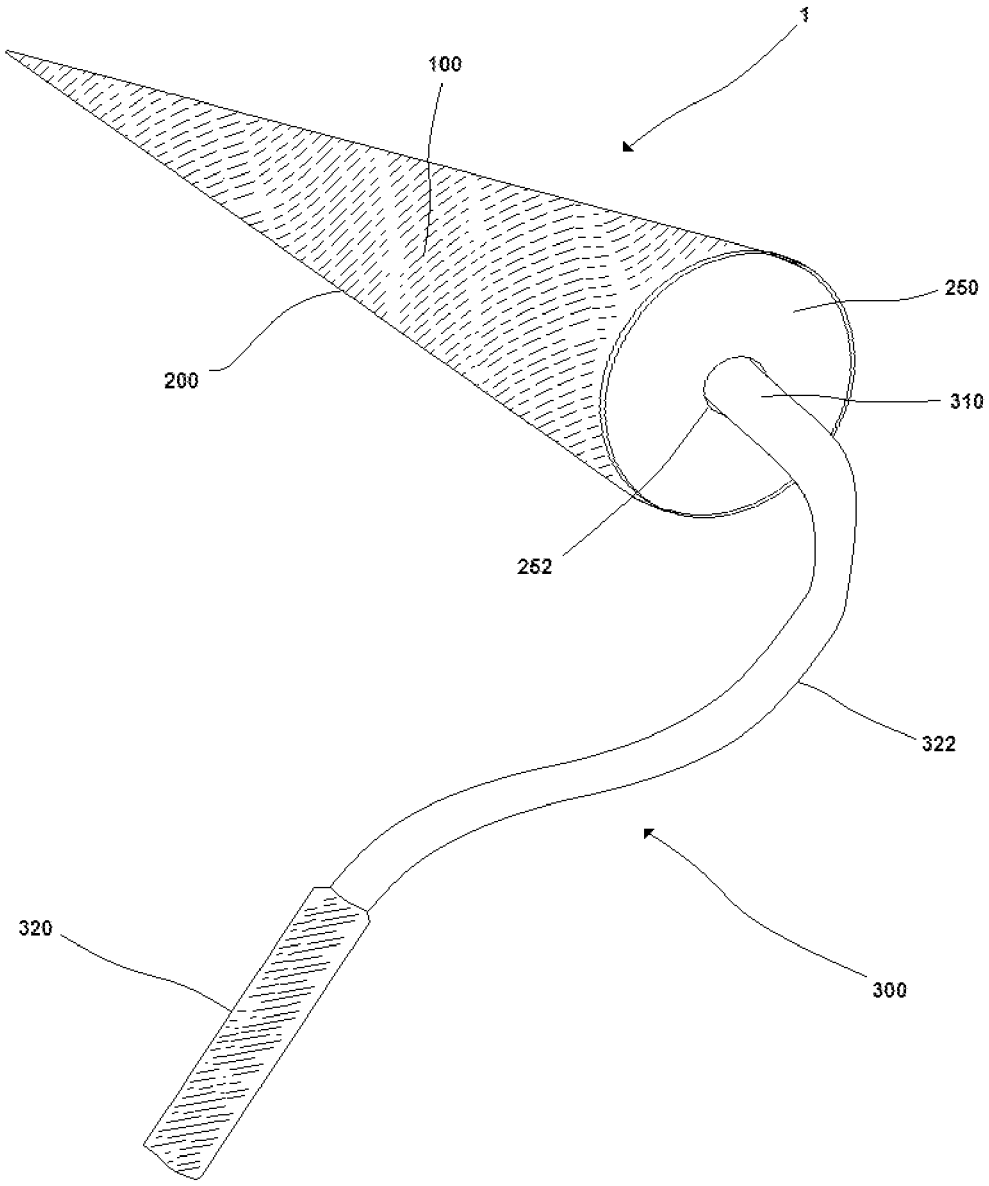
FIG. 6A depicts a perspective view of a configuration of the present invention wherein the roller is substantially conical.
Figure 6B:
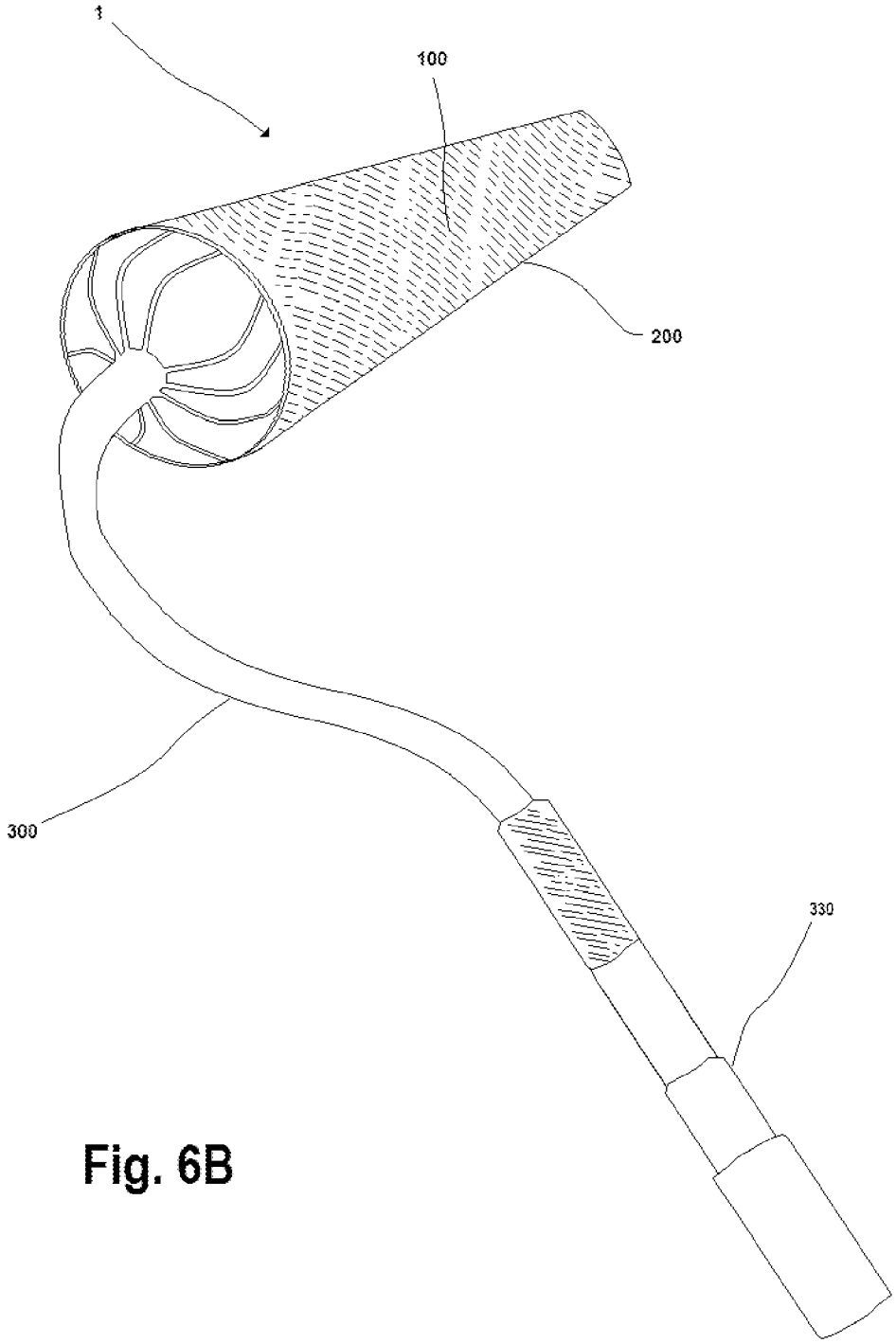
FIG. 6B depicts a perspective view of a configuration of the present invention wherein the roller is substantially frusto conical.

In other embodiments the roller 200 can take other shapes. For example, the roller 200 may be substantially conical. See FIG. 6A. It may also be substantially frusto-conical. See FIG. 6B. These configurations are most practical for rollers 200 affixed to a handle 300 at one end only, with the smaller diameter end of the roller 200 oriented opposite the handle 300. This allows for the relatively smaller diameter end of the roller 200 to reach into corners or other difficult to access surfaces for cleaning. In such embodiments, the roller 200 has a substantially circular cross section with a declining sized diameter at each point along its length. While any dimension for largest diameter and length that is practical may be used for conical rollers 200, in the preferred embodiments the length of the roller 200 should be between four (4) and eighteen (18) inches and the largest diameter of the roller 200 should be between two (2) and four (4) inches.

Figure 3:
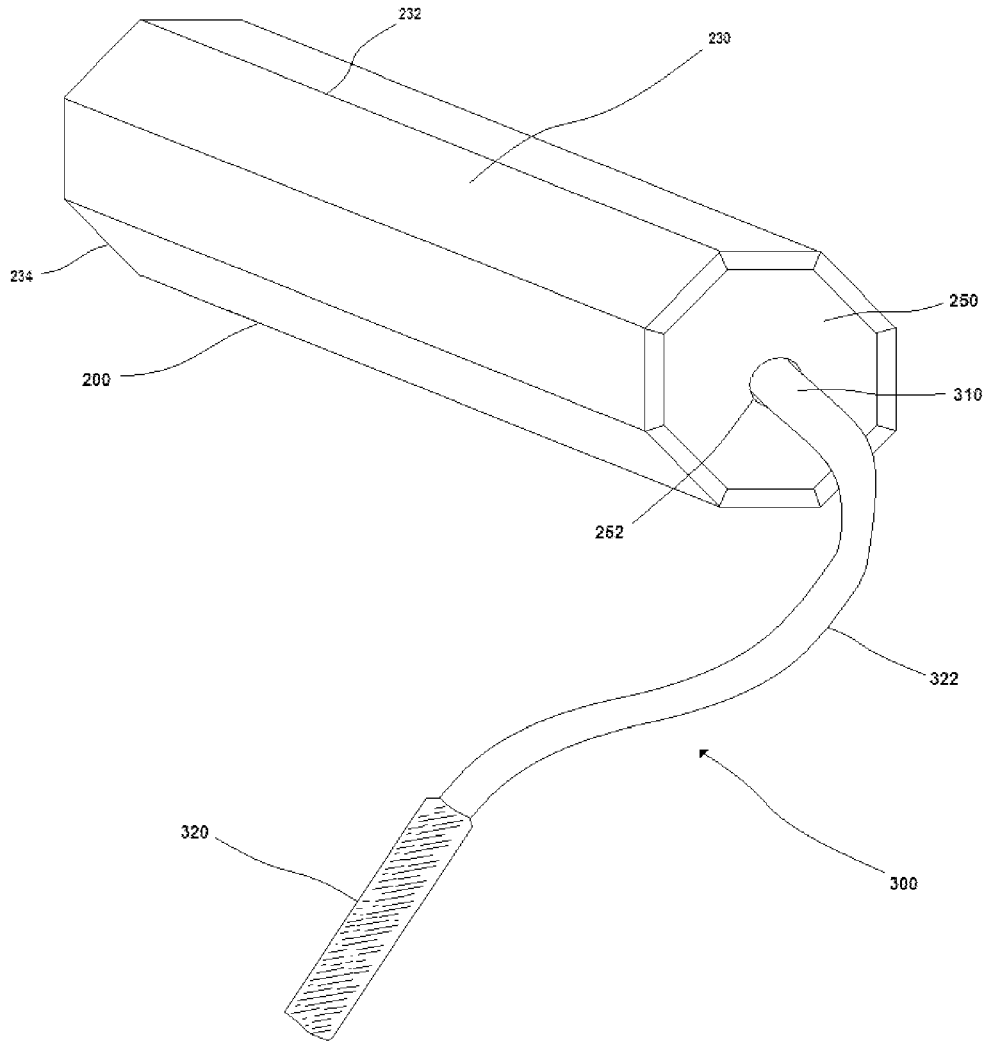
FIG. 3 depicts a perspective view of an alternative embodiment of the roller of the present invention.

In yet other embodiments the roller 200 may be comprised of a plurality of substantially planar rectangular surfaces 230. See FIG. 3. Each rectangular surface 230 will have its long edges 232 collinear with the longitudinal axis of the roller 200. Each rectangular surface 230 moreover will have substantially the same dimensions as each other of the rectangular surfaces 230. The rectangular surfaces 230 form the roller 200 by having their long edges 232 aligned with and in connection with the long edges 232 of adjacent rectangular surfaces 230. So configured, the roller 200 has a regular polygonal cross-section as defined by the short edges 234 of the rectangular surfaces 230. While no set number of rectangular surfaces 230 is required, in the preferred embodiments at least six rectangular surfaces 230 form the roller 200. The fewer rectangular surfaces 230 that are used, the greater the surface area that will be in contact with the surface to be cleaned at any one time, but the more difficult it will be for the user to cause the roller 200 to rotate. The more rectangular surfaces 230 that are used, the easier it will be for the roller 200 to rotate, but a smaller surface area will be in contact with the surface to be cleaned at any one time. In these embodiments, while any combination of diameter and length that is practical may be used for the rollers 200, in the preferred embodiments the length of the roller 200 should be between four (4) and eighteen (18) inches and the largest diameter of the roller 200 should be between one and a half (1½) and four (4) inches.

Figure 2A:
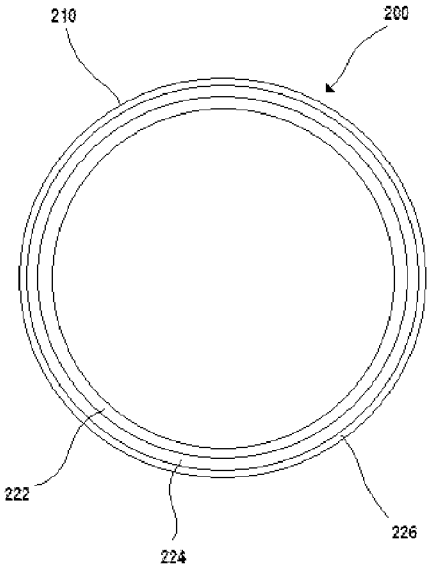
FIG. 2A depicts a plan end view of one embodiment of the present invention having a tri-laminate structure.

In any of the embodiments of the present invention having a roller 200, as described above, the roller 200 may be further comprised of an inner layer 222, a middle layer 224, and an outer layer 226. See FIG. 2A. The middle layer 224 of the roller 200 is adjacent to and in connection with the inner layer 222 of the roller 200. The outer layer 226 of the roller 200 is adjacent to and in connection with the middle layer 224 of the roller 200. In one such tri-laminate embodiment, the inner layer 222 of the roller 200 is constructed of a substantially rigid material which is substantially water impervious. Plastic, polycarbonate, composites, hard rubber, ABS plastic, or other rigid, water impervious materials may be used. The middle layer 224 of the roller 200 is constructed of a flexible material which is suitably adapted to absorb and retain fluids. Open cell foam, natural or synthetic fiber fabrics, sponge, and the like may be used. Finally, the outer layer 226 of the roller 200 is the microfiber cleaning surface 100 itself. These embodiments are suitable for use with cleaning fluids. In other such tri-laminate embodiments, the inner layer 222 of the roller 200 is constructed of a substantially rigid heavy gauge paper, such as cardboard. The middle layer 224 of the roller 200 is constructed of a flexible material to provide cushioning. Foam, natural or synthetic fiber fabrics, and the like may be used. Finally, the outer layer 226 of the roller 200 is the microfiber cleaning surface 100 itself. These embodiments are suitable for dry use of the cleaning system 1. They are also suitable for use as disposable units.

Figure 2B:
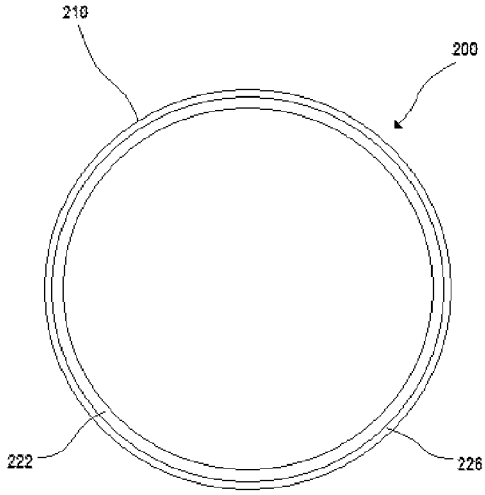
FIG. 2B depicts a plan end view of one embodiment of the present invention having a bi-laminate structure.

In other embodiments of the present invention having a roller 200, as described above, the roller 200 may be further comprised of an inner layer 222 and an outer layer 226. See FIG. 2B. The outer layer 226 of the roller 200 is adjacent to and in connection with the inner layer 222 of the roller 200. In one such bi-laminate embodiment, the inner layer 222 of the roller 200 is constructed of a substantially rigid material which is substantially water impervious. Plastic, polycarbonate, composites, hard rubber, ABS plastic, or other rigid, water impervious materials may be used. The outer layer 226 of the roller 200 is the microfiber cleaning surface 100 itself. These embodiments may be used with cleaning fluids. In other such bi-laminate embodiments, the inner layer 222 of the roller 200 is constructed of a substantially rigid heavy gauge paper, such as cardboard. The outer layer 226 of the roller 200 is the microfiber cleaning surface 100 itself. These embodiments are suitable for dry use of the cleaning system 1. They are also suitable for use as disposable units.

Figure 4A:
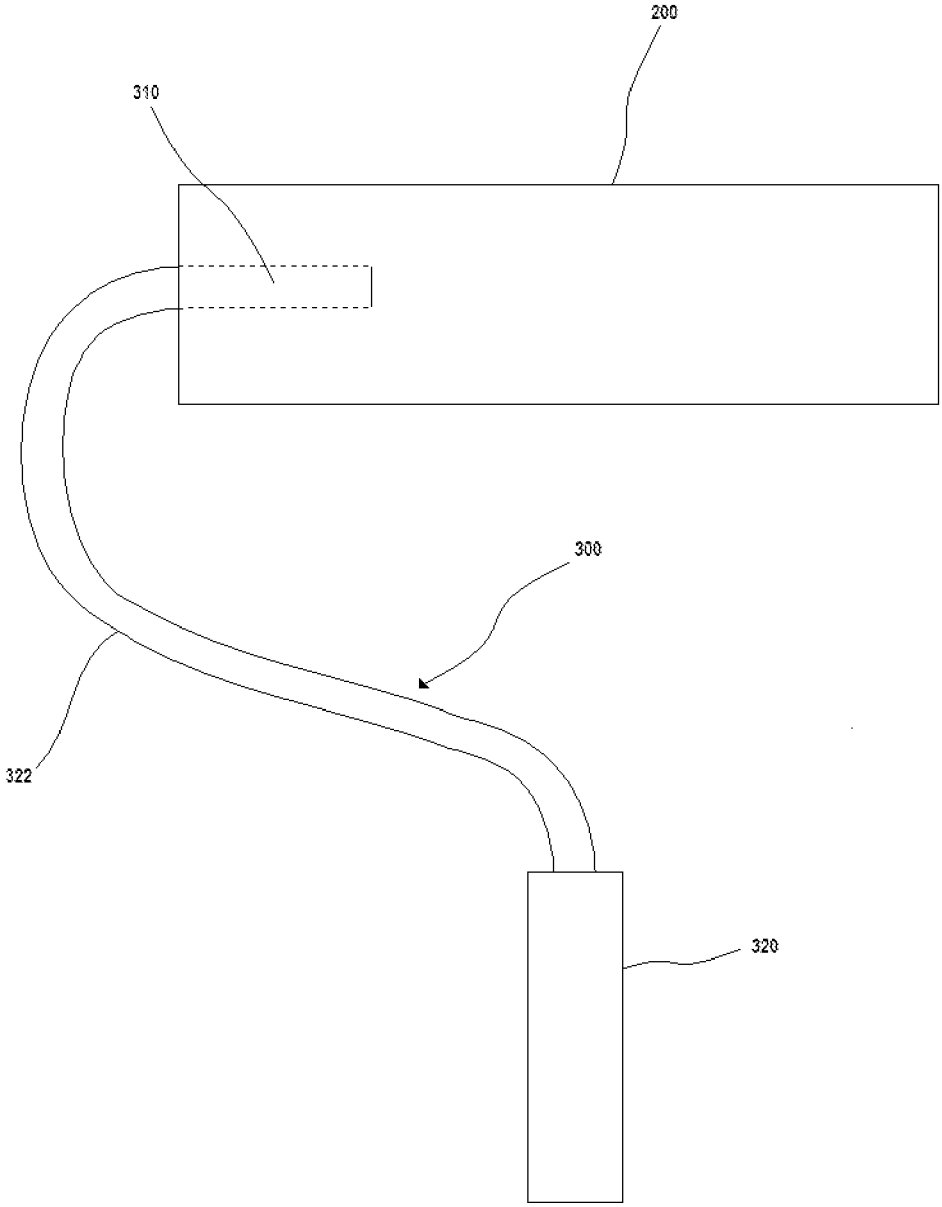
FIG. 4A depicts a plan view of one configuration of the roller and handle combination of the present invention involving a handle having a single axle partially inserted into one end of the roller (with the portion of the axle within the roller represented by ghost lines).
Figure 4B:
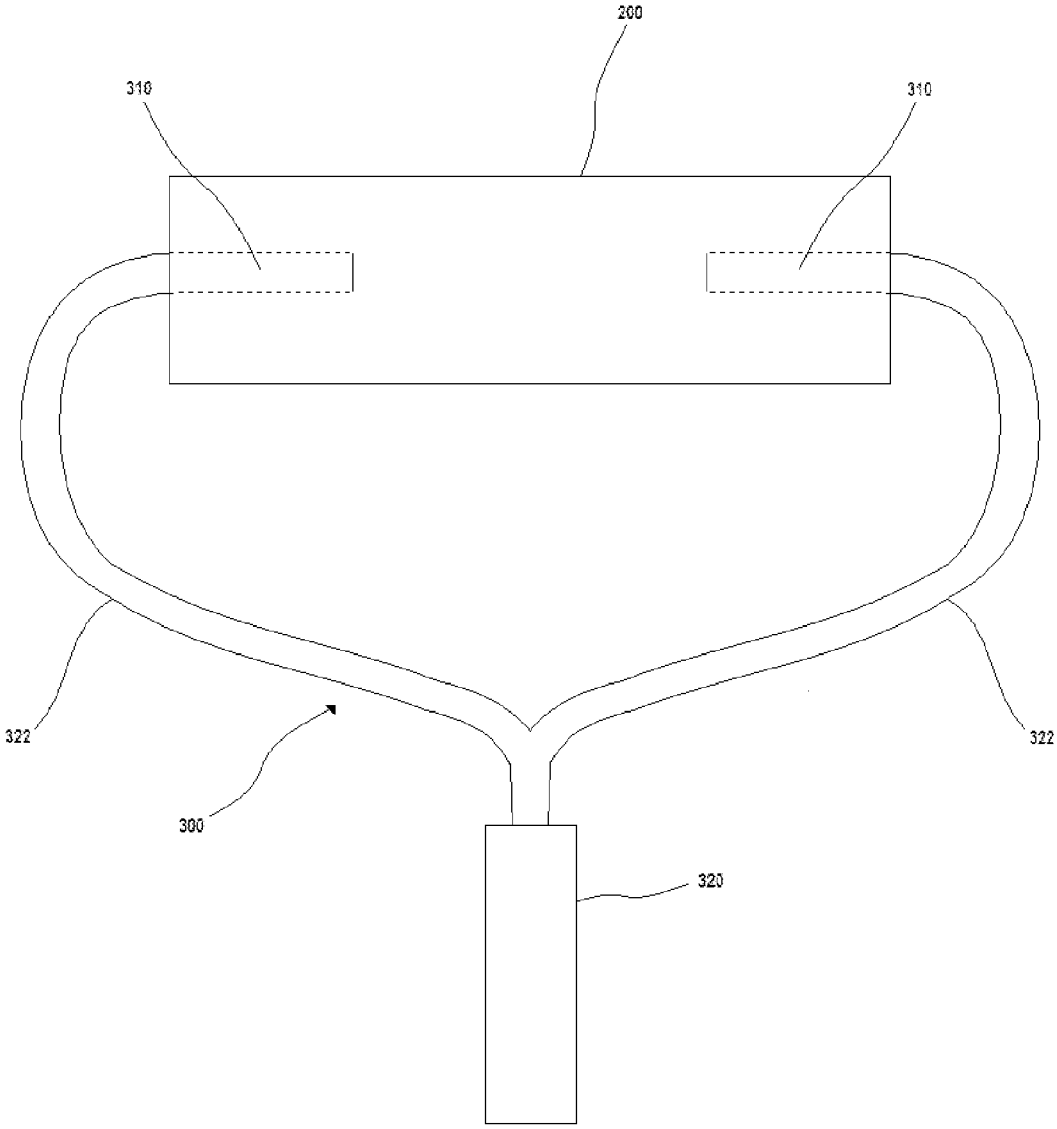
FIG. 4B depicts a plan view of another configuration of the roller and handle combination of the present invention involving a handle having dual axles partially inserted into each end of the roller (with the portion of the axles within the roller represented by ghost lines).
Figure 4C:
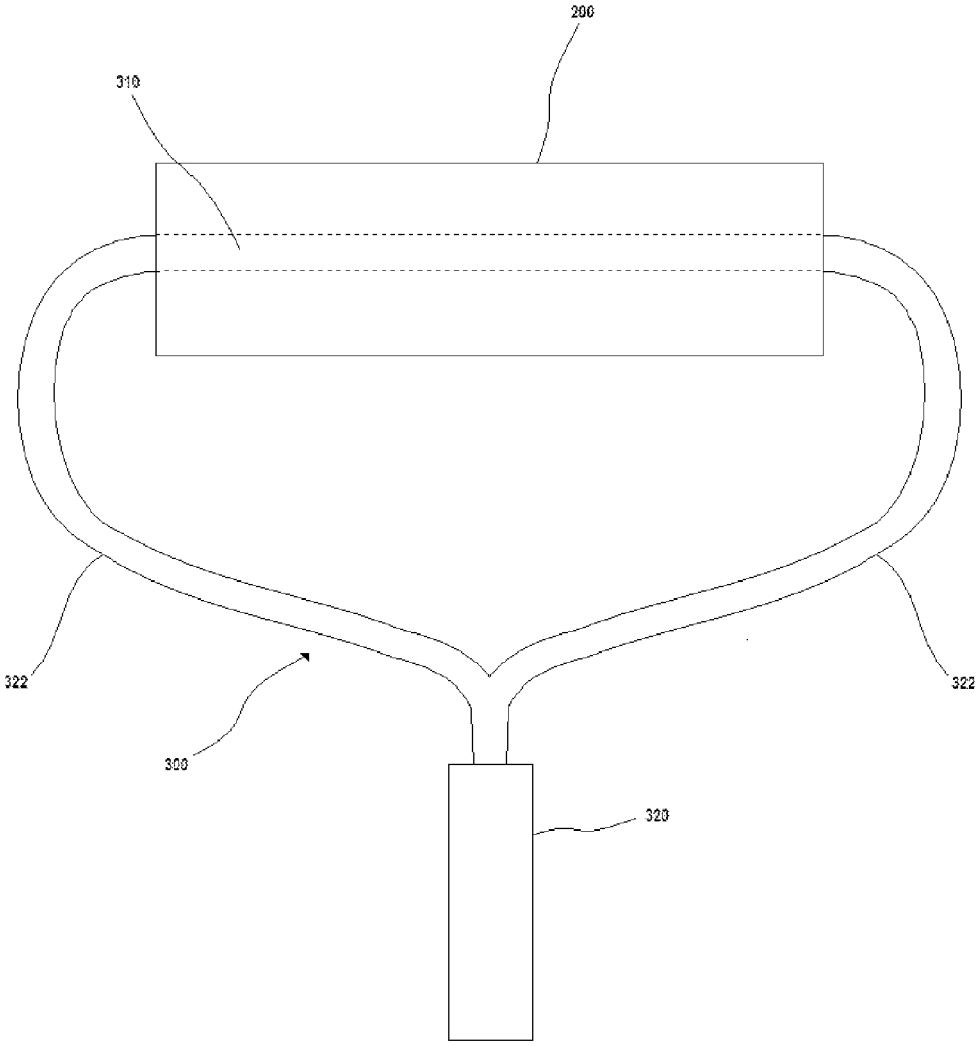
FIG. 4C depicts a plan view of yet another configuration of the roller and handle combination of the present invention involving a handle having a single axle passing completely through the roller and extending from each end of the roller (with the portion of the axle within the roller represented by ghost lines).

In any of the embodiments of the present invention having a roller 200, as described above, the present invention may also comprise a handle 300, to which the roller 200 is suitably adapted to be rotatably attached. See FIG. 1B. The handle 300 comprises at least one axle 310 and a gripping member 320, with the axle 310 providing the connection to the roller 200 and the gripping member 320 being suitably adapted to be held by a human hand. In one embodiment the handle 300 may comprise a single axle 310, with the axle 310 suitably adapted to be inserted at least partially into one end of the roller 200 and aligned substantially along the longitudinal axis of the roller 200, with the non-inserted end of the axle 310 extending from the roller 200, such that the roller 200 is capable of rotating about the axle 310. See FIG. 4A. The handle 300 may also comprise a pair of axles 310, with each axle 310 suitably adapted to be inserted at least partially into each end of the roller 200, one axle 310 into each end, with both axles 310 aligned substantially along the longitudinal axis of the roller 200 and with the non-inserted ends of the axles 310 extending from the roller 200, such that the roller 200 is capable of rotating about the axles 310. See FIG. 4B. In yet another embodiment the handle 300 may comprise a single axle 310 passing completely through the roller 200 and extending from each end of the roller 200, with the axle 310 aligned substantially along the longitudinal axis of the roller 200 such that the roller 200 is capable of rotating about the axle 310. See FIG. 4C. In each such embodiment the gripping member 320 is in connection with the axle 310 or axles 310. A flange 322 may connect the gripping member 320 with the non-inserted end of an axle 310. Where a pair of axles 310 is used, a pair of flanges 322 may connect the gripping member 320 to the non-inserted ends of each axle 310. Where a single axle 310 passing completely through the roller 200 is used, a single flange 322 may connect the gripping member 320 with one end of the axle 310, or a pair of flanges 322 may connect the gripping member 320 to each end of the axle 310. Each flange 322 may have any suitable shape, such as straight, curved, angled, or the like.

Where the handle 300 is a standard paint roller handle, there may be multiple axles 310 upon which the roller 200 may be rotatably attached. See FIG. 6B. In such a configuration the axles 310 are curved and are suitably adapted such that at least a portion of each axle 310 may be wedged against the inner surface of the roller 200 to secure the roller 200 to the handle 300. In such configurations there may be no axle 310 aligned with the longitudinal axis of the roller 200, though all such axles 310 are arranged about a midline which is aligned with the longitudinal axis of the roller 200.

The handle 300 may further comprise an extension 330, suitably adapted to be removably attached to the gripping member 320, whereby the extension 330 is of a suitable length to allow the device to be used on difficult to reach surfaces, such as ceilings and the upper portions of walls. See FIG. 6B. The extension 330 may be in threaded connection with the gripping member 320, or may snap onto the gripping member 320, or may be attached to the gripping member 320 in any other practical manner known in the art. The end of the extension 330 opposite its connection with the gripping member 320 must be suitably adapted to be held by a human hand. The extension 330 may comprise multiple sections in telescopic relation to each other, to allow for greater or lesser reach of the device. See FIG. 6B.

In embodiments of the present invention having a roller 200 and a handle 300, the ends of the roller 200 may comprise one or more end caps 250, with each end cap 250 suitably configured to retain an axle 310 of the handle 300. See FIGS. 1A, 1B, 3, and 6A. The end caps 250 may be constructed of any suitable, substantially rigid material, such as plastic or heavy gauge paper. Where the roller 200 is substantially cylindrical, each end cap 250 will be substantially circular, having a diameter substantially the same as the inside diameter of the roller 200 such that the end cap 250 can be inserted into the end of the roller 200 and held therein by frictional forces. See FIG. 1A. Adhesives may also be used to retain the end caps 250 within the roller 200. The end caps 250 for rollers 200 having non-circular cross sections will be configured with an outer perimeter having substantially the same shape and dimension as the inner perimeter of the interior of the roller 200, with the end caps 250 secured therein in the same manner. See FIG. 3. In all configurations of end caps 250, each end cap 250 will contain a central aperture 252 sized to snugly accommodate an axle 310 of the handle 300. See FIGS. 1A, 1B, 3, and 6A.

Figure 5:
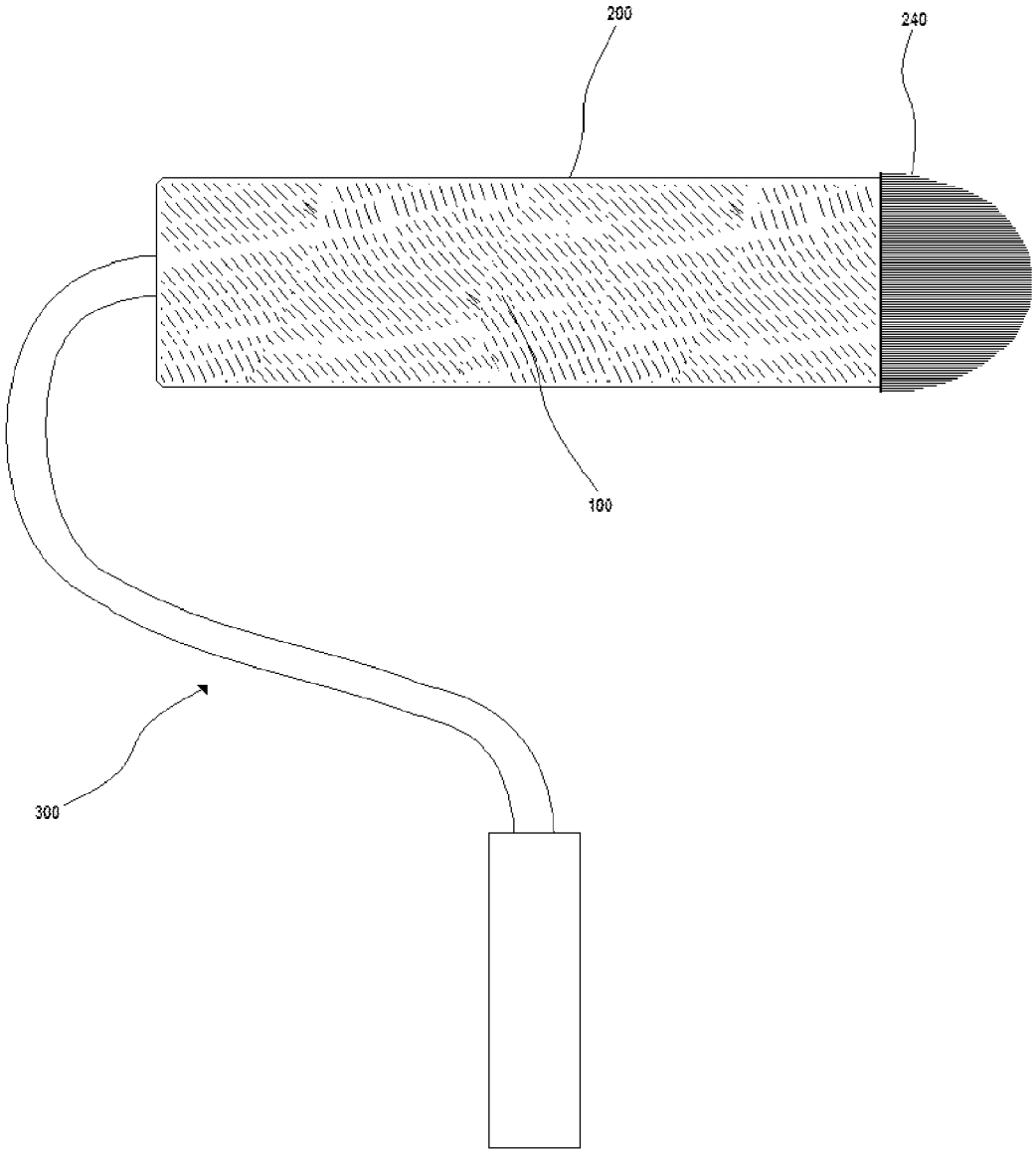
FIG. 5 depicts a plan view of yet another configuration of the present invention involving a brush on the end of the roller.

In embodiments of the present invention having a roller 200 and a handle 300 with a single axle 310 and flange 322 configuration, the end of the roller 200 opposite the end accommodating the axle 310 may comprise a brush 240. See FIG. 5. The brush 240 may be of any suitable shape and bristle configuration. The brush 240 may be inserted into the end of the roller 200 and held therein by frictional forces, or attached to the end of the roller 200 with an adhesive, or placed over the end of the roller 200 and secured thereto by any conventional means.

In the aspect of the present invention comprising a cleaning surface 100 suitably adapted to be removably attached to a roller 200, the cleaning surface 100 may be a removable cover sized and shaped to be snugly placed over the roller 200 and secured thereto. See FIG. 7A. In one embodiment the cover is opened at both ends; in another embodiment the cover is opened at one end and closed at the other end. The cover may have a frictional inner surface to allow it to be better secured in place to the roller 200. In yet another embodiment the cleaning surface 100 may be a removable flexible sleeve sized and shaped to be snugly placed over the roller 200 and secured thereto. See FIG. 7B. In one embodiment the sleeve is opened at both ends; in another embodiment the sleeve is opened at one end and closed at the other end. The cleaning surface 100 may further comprise an attachment component 110, with the attachment component 110 suitably adapted to secure the cleaning surface 100 to the roller 200. See FIG. 7B. The attachment component 100 may be of any suitable configuration, including an elastic band attached circumferentially about an open end of the sleeve, a drawstring threaded circumferentially about an open end of the sleeve, or hooks, snaps, or Velcro™ closures attached to an open end of the sleeve. See FIG. 7B. The roller 200 onto which the cleaning surface 100 is placed may be any suitable roller 200, for example, a standard paint roller 200. This aspect of the present invention is suitable for use as disposable units.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention as defined in the following claims in which all terms are meant in their broadest, reasonable sense.

I claim:

1. A surface cleaning system comprising a conventional paint roller, of the type used to apply paint to a wall or ceiling, said roller having an outer surface; and a cleaning surface, said cleaning surface being a removably attachable separate component from said roller, said cleaning surface comprised of microfiber material and being electrostatically charged;

wherein the cleaning surface is adjacent to the outer surface of the roller, and the roller is suitably adapted to be rotatably attachable to a handle.

2. The surface cleaning system of claim 1 wherein the roller is substantially cylindrical.

3. The surface cleaning system of claim 1 wherein the roller is substantially conical.

4. The surface cleaning system of claim 1 wherein the roller is comprised of at least eight substantially planar rectangular surfaces, with each said rectangular surface having a pair of long edges and a pair of short edges, each rectangular surface having substantially the same dimensions as each other of the rectangular surfaces, and each long edge of each rectangular surface being aligned with and in connection with a long edge of an adjacent rectangular surface, such that the roller has a regular polygonal cross-section.

5. The surface cleaning system of claim 1 wherein the roller is further comprised of an inner layer, a middle layer, and an outer layer, with the middle layer adjacent to and in connection with the inner layer and the outer layer adjacent to and in connection with the middle layer.

6. The surface cleaning system of claim 1 wherein the roller is further comprised of an inner layer and an outer layer, with the outer layer adjacent to and in connection with the inner layer.

7. The surface cleaning system of claim 1 wherein the roller is further comprised of a brush having bristles, said brush located at an end of the roller.

8. The surface cleaning system of claim 1 further comprising a handle, wherein the roller is suitably adapted to be rotatably attached to the handle.

9. The surface cleaning system of claim 8 wherein the handle comprises an axle, said axle suitably adapted to be placed at least partially within the roller, such that the roller rotates about the axle; and a gripping member, said gripping member in connection with the axle, said gripping member suitably adapted to be held by a human hand.

10. The surface cleaning system of claim 9 wherein the axle passes completely through the roller, extending from each end of the roller, with the gripping member of the handle in connection with one end of the axle.

11. The surface cleaning system of claim 10 wherein the gripping member of the handle comprises a pair of flanges, with each flange in connection with an end of the axle.

12. The surface cleaning system of claim 8 wherein the roller comprises a first end and a second end; and the handle comprises a pair of axles, each said axle suitably adapted to be placed partially within the roller, with one axle inserted into the first end of the roller and the other axle inserted into the second end of the roller, such that the roller rotates about the axles, and a gripping member, said gripping member suitably adapted to be held by a human hand, said gripping member comprised of a pair of flanges, with each flange in connection with one of the axles.

13. A surface cleaning system comprising a cleaning surface, said cleaning surface comprised of microfiber material being electrostatically charged;

wherein the cleaning surface is suitably adapted to be removably attachable to a conventional paint roller of the type used to apply paint to a wall or ceiling, said roller being rotatably attachable to a handle.

14. The surface cleaning system of claim 13 wherein the cleaning surface is a rigid or semi-rigid cover suitably sized and shaped to be placed snugly over the roller.

15. The surface cleaning system of claim 13 wherein the cleaning surface is a flexible sleeve suitably adapted to be snugly placed over the roller and secured thereto.

16. The surface cleaning system of claim 13 wherein the cleaning surface comprises an attachment component suitably adapted to secure the cleaning surface to the roller, said attachment component comprising one of the following group: elastic band, drawstring, hook, snap, and hook-and-loop fastener style closure.

* * * * *